US005566838A

United States Patent [19]

Tseng

[11] Patent Number: 5,566,838

[45] Date of Patent: Oct. 22, 1996

[54] SHOE-RACK ASSEMBLY WITH A HEATING DEVICE

[76] Inventor: Lung-Hai Tseng, No. 40-30, Kuang-Hsing Rd., Tai-Ping Hsiang, Taichung Hsien, Taiwan

[21] Appl. No.: 381,764

[22] Filed: Feb. 1, 1995

[51] Int. Cl.[6] ..... A47F 7/08

[52] U.S. Cl. ..... 211/37; 211/34; 219/521; 219/215; 34/239

[58] Field of Search ..... 211/34, 37; 219/521, 219/215, 385, 386; 34/219, 239

[56] References Cited

U.S. PATENT DOCUMENTS

| | | | |
|---|---|---|---|
| D. 165,942 | 2/1952 | Stein | 211/34 X |
| D. 324,620 | 3/1992 | Chalot | 211/16 X |
| 2,098,735 | 11/1937 | Yentis | 219/521 |
| 2,571,918 | 9/1950 | Meninger | 219/521 X |
| 3,705,974 | 12/1972 | Nilsson | 219/521 X |
| 3,965,808 | 6/1976 | Chomette | 219/386 X |
| 4,117,309 | 9/1978 | Cayley | 219/521 X |
| 4,145,602 | 3/1979 | Lee | 211/34 X |
| 4,200,993 | 5/1980 | Blanc et al. | 211/34 X |
| 4,559,442 | 12/1985 | Graham | 219/521 X |
| 4,727,656 | 3/1988 | Jannach et al. | 34/239 X |
| 5,320,030 | 6/1994 | Hubbard | 219/521 X |
| 5,378,995 | 1/1995 | Kudo et al. | 324/693 |

FOREIGN PATENT DOCUMENTS

| | | | |
|---|---|---|---|
| 128751 | 8/1948 | Australia | 219/521 |
| 1222667 | 6/1960 | France | 219/215 |
| 1283135 | 12/1961 | France | 34/239 |

OTHER PUBLICATIONS

Hugh Lyons and Co. p. 115, Item 837.

"Towel Warmers in Chrome or Brass," Heartland America Catalog, unknown page number.

*Primary Examiner*—Alvin C. Chin-Shue
*Assistant Examiner*—Brian J. Hamilla
*Attorney, Agent, or Firm*—Ladas & Parry

[57] ABSTRACT

A shoe rack assembly with a heating device which can heat a number of shoes simultaneously and economically. The shoe-rack assembly comprises: a supporting device including two inverted U-shaped brackets with a flat top portion having a central hole and two threaded holes; a pipe with two ends disposed on the supporting device, one end having an electrical connector connected thereto, the electrical connector having two terminals; a pair of clamping units attached to each bracket by screws extending through the threaded holes of the bracket, the clamping units having an inverted, T-shaped positioning seat and an inverted, U-shaped retaining hook for fastening the ends of the pipe to the supporting device, the positioning seat and retaining hook securing the pipe by a threaded bolt that passes though the central hole of the bracket, an aperture in a partition of a vertical hollow bar of the positioning seat and engages a threaded hole of a connecting plate of the retaining hook; at least one thermally conductive hollow tube member having a wavy configuration to support shoes placed thereon, the hollow tube member also having two ends connected to the pipe; and at least one resistance heating wire extending through the hollow tube member.

4 Claims, 4 Drawing Sheets

SHOE-RACK ASSEMBLY WITH A HEATING DEVICE

BACKGROUND OF INVENTION

1. Field of the Invention

This invention relates to a shoe-rack assembly, more particularly to a shoe-rack assembly with a heating device for drying a number of pairs of shoes simultaneously.

2. Description of the Related Art

Conventionally, air dryers are widely used to dry wet shoes. In winter, air dryers may also be used to warm shoes up. In use, an air dryer dries and warms up the shoes one by one. This is a time-consuming and monotonous work.

SUMMARY OF THE INVENTION

It is therefore a main object of this invention to provide a shoe-rack assembly with a heating device which can heat a number of shoes simultaneously and economically.

Accordingly, the shoe-rack assembly of this invention comprises a supporting device, a pipe, a fastening means, at least one thermally conductive hollow tube member, and at least one resistance heating wire. The pipe is disposed on the supporting device. An electrical connector is connected to one of the ends of the pipe. Two terminals are mounted on the electrical connector. The fastening means is provided for fastening the pipe to the supporting device. The tube member is connected to the pipe and has a wavy configuration with a plurality of peaks which are adapted to insert into and support the shoes. The resistance heating wire extends through the tube member and has two ends connected to the terminals of the electrical connector.

Therefore, a number of pairs of shoes can be disposed on peaks of the tube member of the shoe-rack assembly of this invention and can be dried and warmed when the resistance heating wire is energized to heat the tube member. Since a number of pairs of shoes can be heated and dried, the energy consumption is lower than that of the air dryer for shoes of the prior art.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
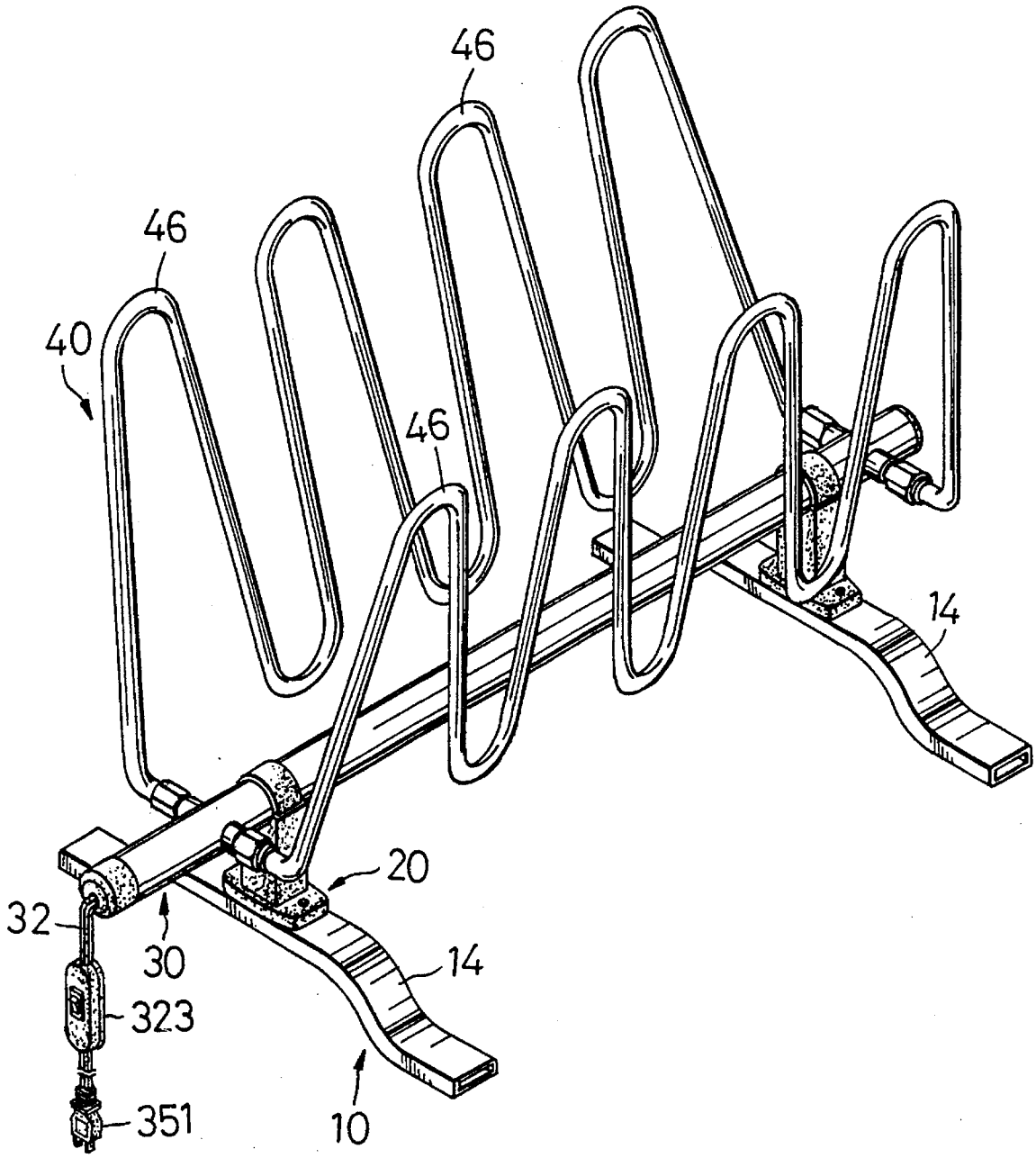
FIG. 1 is a perspective view of a preferred embodiment of a shoe-rack assembly of this invention.

Referring to FIG. 1, a preferred embodiment of a shoe-rack assembly of this invention is shown to comprises a supporting device 10, a fastening means 20, a pipe 30, and two thermally conductive hollow tube members 40.

Figure 2:
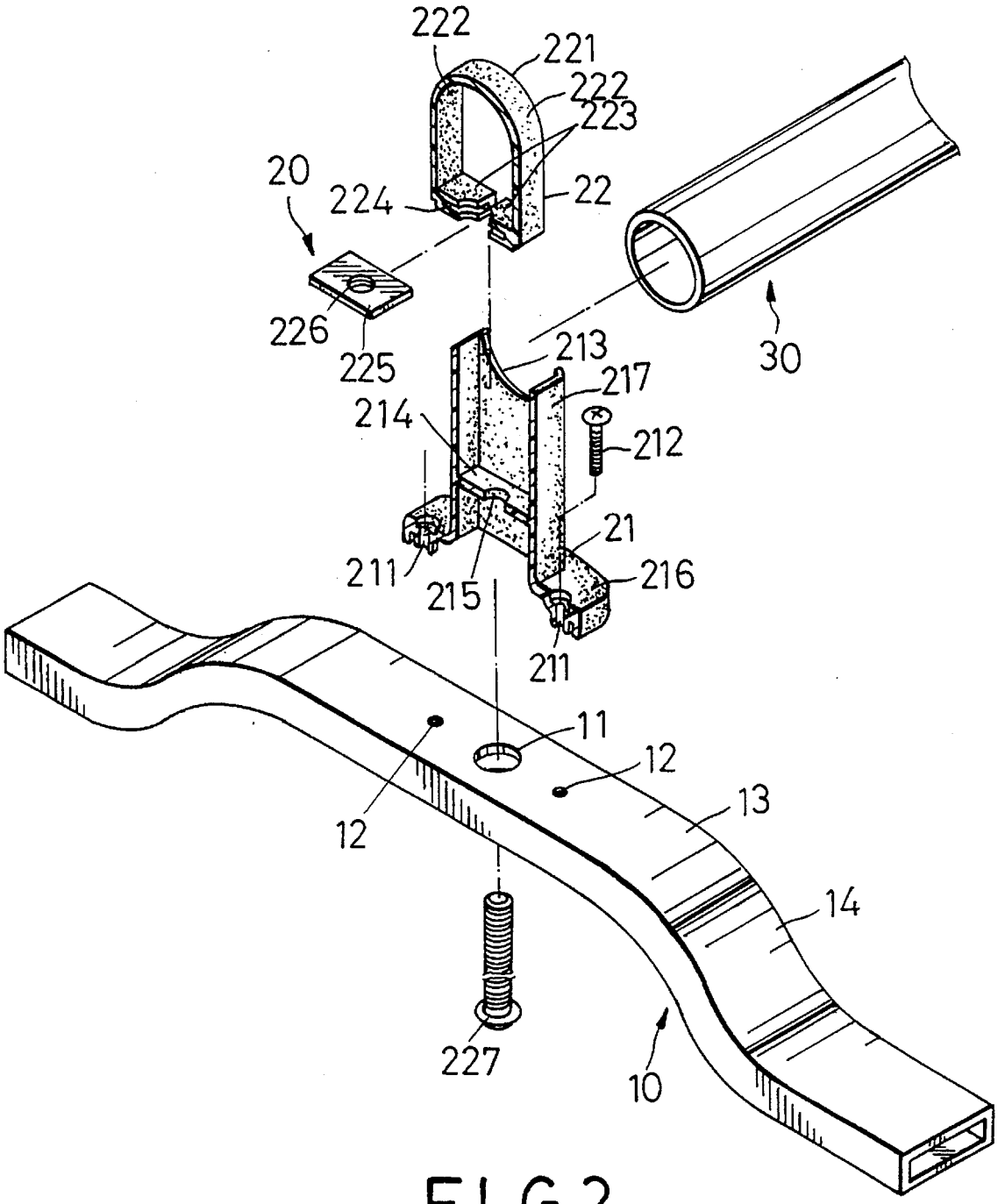
FIG. 2 is a fragmentary perspective view of the preferred embodiment of the shoe-rack assembly of this invention.

Referring to FIG. 2, the supporting device 10 includes two inverted U-shaped brackets 14. Each of the brackets has a flat top portion 13 with a central hole 11 and two threaded holes 12 formed on two sides of the central hole 11.

The fastening means 20 includes two pairs of clamping units that are releasably connected adjacent to the ends of the pipe 30 in order to fasten the pipe 30 to the supporting device 10, as shown in FIG. 1, which will be described in detail hereinbelow. Each pair of the clamping units 20 has a positioning seat 21 and a retaining hook 22 which is connected releasably to the positioning seat 21. In this embodiment, only one pair of clamping units 20 and one bracket 14 are described because the structure and the function of all the clamping units 20 and all the brackets 14 is the same. The positioning seat 21 is inverted, T-shaped, and has a crossbar 216 and a vertical hollow bar 217. The vertical hollow bar 217 has a transverse partition 214 formed at an intermediate section thereof. The transverse partition 214 has an aperture 215 which is aligned with the central hole 11 of the bracket 14. The crossbar 216 has two through holes 211 which are aligned respectively with the two threaded holes 12 of the bracket 14. The upper end of the vertical hollow bar 217 has an arcuated notch 213 which corresponds with a lower face of the pipe 30, so that the pipe 30 can be stably supported by the positioning seat 21.

Figure 3:
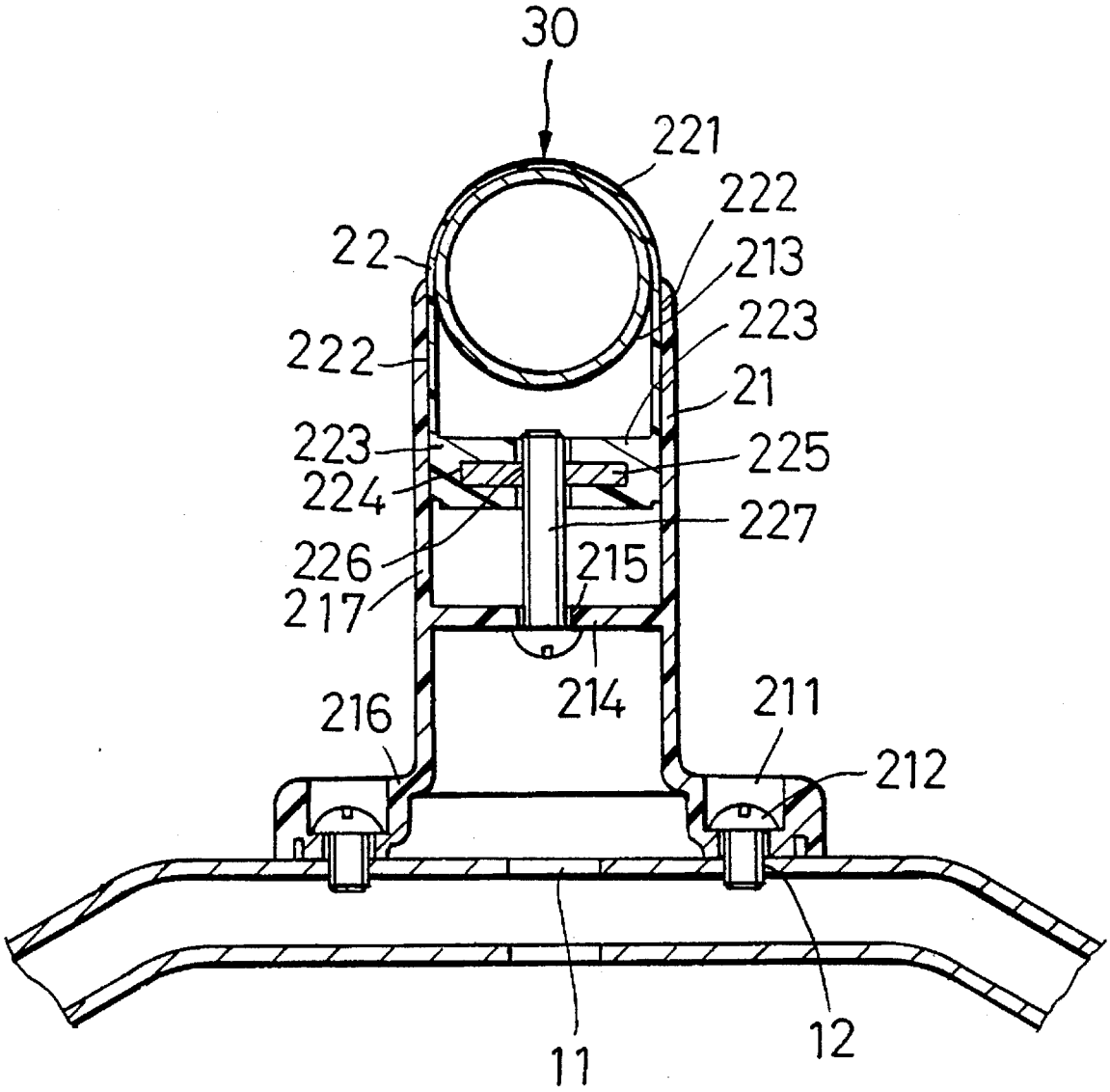
FIG. 3 is a fragmentary partial sectional view of the shoe-rack assembly of this invention.

The retaining hook 22 of the clamping unit 20 is inverted U-shaped and has two leg portions 222 extending into the upper end of the vertical hollow bar 217 of the positioning seat 22. The leg portions 222 of the retaining hook 22 have two opposite engaging plates 223 extending toward each other from the free ends of the leg portions 222. Each of the engaging plates 223 has a transverse receiving slot 224. A horizontal connecting plate 225 is inserted into the transverse receiving slots 224 and thereby is connected perpendicularly between the two leg portions 222 of the retaining hook 22, as best illustrated in FIG. 3. The connecting plate 225 has a threaded hole 226 formed therein. A threaded bolt 227 passes through the central hole 11 of the bracket and the aperture 215 of the partition 214 of the vertical hollow bar 217, and engages the threaded hole 224 of the connecting plate 225. One of the ends of the pipes 30 passes between the two leg portions 222 of the retaining hook 22 and is clamped between the upper end of the vertical hollow bar 217 of the positioning seat 216 and an upper portion 221 of the retaining hook 22 in order to fix the pipe 30 to the brackets 40. Two screws 212 extend downwardly through the two through holes 211 of the crossbar 216 of the positioning seat 22, and are threaded into the two threaded holes 12 of the bracket 14 in order to fix the clamping unit 20 to the bracket 10.

Figure 4:
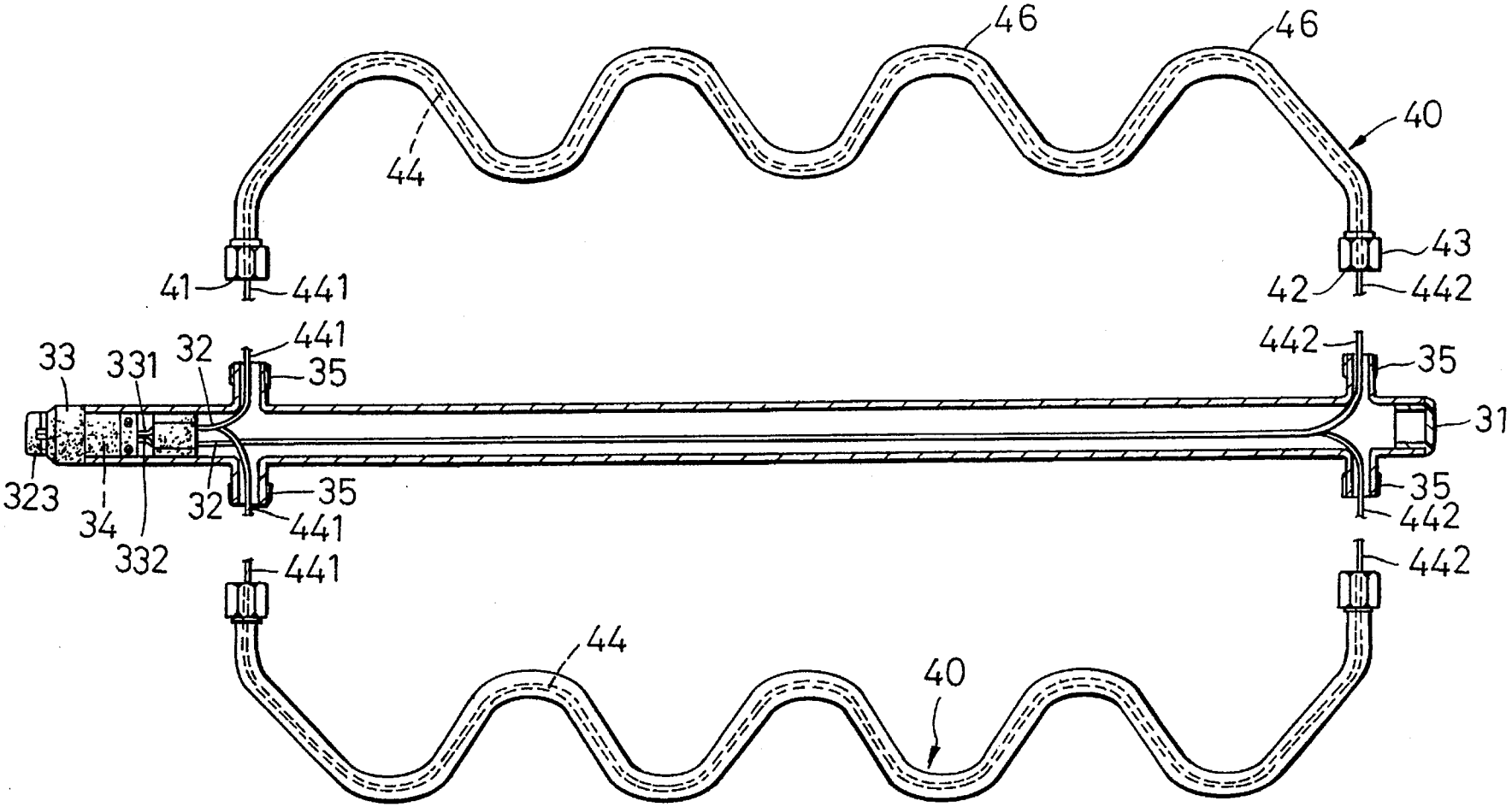
FIG. 4 is an exploded sectional top view of the. pipe and the tube members of the shoe-rack assembly of this invention.

Referring to FIG. 4, the pipe 30 has two pairs of externally threaded projections 35. The ends 41, 42 of each of the tube members 40 are provided with two screw nuts 43 which are connected to the two externally threaded projections 35, as best illustrated in FIG. 1. One end of the pipe 30 is closed by a cap member 31, and the other end of the pipe 30 is connected with an electrical connector 33 by means of a screw member 34. The electrical connector 33 has two terminals 331, 332 mounted therein, and has an electrical wire 32 with a plug 351 to be connected to a power source (not shown). An ON/OFF switch 323 may be connected to the electrical wire 32. Two resistance heating wires 44 are housed within and extend through the two tube members 40. Each of the tube members 40 has a wavy configuration with a plurality of peaks 46 which are adapted to insert into and support shoes, as best illustrated in FIG. 1. Each of the resistance heating wires 44 has two ends 441, 442 connected to the two terminals 331, 332 of the electrical connector 33. The resistance heating wires 44 can be energized to heat the tube members 40 when the plug 351 is connected to the power source and the switch 323 is in the ON position. Thereby, the tube members 40 can be heated to about 45° C. within about 12 minutes. A number of shoes which are disposed on the peaks 46 can be thus dried and warmed simultaneously. Since a number of pairs of shoes can be heated and dried simultaneously, the energy consumption is lower than that of the air dryer for shoes of the prior art.

With this invention thus explained, it is apparent that numerous modifications and variations can be made without departing from the scope and spirit of this invention. It is therefore intended that this invention be limited only as indicated in the appended claims.

I claim:

1. A shoe-rack assembly comprising:

a supporting device wherein said supporting device includes two inverted U-shaped brackets, each of said brackets having a flat top portion with a central hole and two threaded holes each disposed on an opposite side of said central hole;

a pipe with two ends disposed on said supporting device, one of said ends of said pipe having an electrical connector connected thereto, said electrical connector having two terminals mounted therein;

means for fastening said pipe to said supporting device wherein said fastening means includes two pairs of clamping units releasably connected adjacent to said two ends of said pipe, each pair of said clamping units having a positioning seat and a retaining hook which is connected releasably to said positioning seat, said positioning seat being inverted, T-shaped, and having a crossbar and a vertical hollow bar connected to said crossbar, said vertical hollow bar having a transverse partition formed at an intermediate section thereof, said transverse partition having an aperture which is aligned with said central hole of one of said brackets, said crossbar having two through holes which are aligned respectively with said two threaded holes of one of said brackets, said retaining hook of each pair of said clamping units being inverted, U-shaped, and having two leg portions extending into an upper end of said vertical hollow bar of one of said clamping units, said two leg portions having a connecting plate connected perpendicularly therebetween, said connecting plate having a threaded hole formed therein, each of said pairs of said clamping units having a threaded bolt passing upwardly through said central hole of one of said brackets, passing upwardly through said aperture of said partition of said vertical hollow bar of one of said pairs of said clamping unit, and engaging said threaded hole of said connecting plate of said retaining hook of one of said pairs of said clamping units, each of said ends of said pipes passing between said two leg portions of said retaining hook of one of said pairs of clamping units and being clamped between said upper end of said vertical hollow bar and an upper portion of said retaining hook of one of said pairs of clamping units, each of said clamping units having two screws extending downwardly through said two through holes of said crossbar thereof, and being threaded into said two threaded holes of said brackets;

at least one thermally conductive hollow tube member having two ends connected to said pipe, said tube member having a wavy configuration with a plurality of peaks which are adapted to insert into and support shoes; and at least one resistance heating wire extending through said tube member and having two ends connected respectively to said two terminals of said electrical connector.

2. A shoe-rack assembly as claimed in claim 1, wherein said upper end of said vertical hollow bar of each of said clamping units has an arcuated notch which corresponds to a lower face of said pipe.

3. A shoe-rack assembly as claimed in claim 2, wherein said leg portions of said retaining hook of each of the pairs of said clamping units have two opposite engaging plates extending toward each other from free ends of said leg portions, each of said engaging plates having a transverse receiving slot in which said connecting plate is inserted.

4. A shoe-rack assembly as claimed in claim 1, wherein said pipe has at least two externally threaded projections and said ends of said tube member are provided respectively with two screw nuts which are connected to said two externally threaded projections.

* * * * *